United States Patent [19]

Hackett

[11] Patent Number: 4,545,629

[45] Date of Patent: Oct. 8, 1985

[54] ROTATING GARBAGE CAN RACK WITH COVER

[76] Inventor: Kenneth P. Hackett, 5209 Franklin Rd., Nashville, Tenn. 37220

[21] Appl. No.: 470,316

[22] Filed: Feb. 28, 1983

[51] Int. Cl.[4] ..... A47B 49/00

[52] U.S. Cl. ..... 312/252; 312/100; 312/266; 312/284

[58] Field of Search ..... 248/131, 349, DIG. 7; 135/102, 99; 52/64, 65, 80, 82; 312/3, 125, 266, 135, 100, 250, 284, 305, 252

[56] References Cited

U.S. PATENT DOCUMENTS

| | | | |
|---|---|---|---|
| 657,593 | 9/1900 | Dix | 312/3 |
| 1,114,933 | 10/1914 | Stricklen | 135/102 |
| 1,162,290 | 11/1915 | Koken | 211/78 |
| 1,183,508 | 5/1916 | Waterston | 248/131 |
| 1,398,211 | 11/1921 | Wallace . | |
| 1,569,584 | 1/1926 | Shover | 248/DIG. 7 |
| 1,906,923 | 5/1933 | Allen et al. | 52/82 |
| 2,605,067 | 7/1952 | Lindsell | 248/349 |
| 2,605,989 | 8/1952 | Luft | 248/349 |
| 2,667,360 | 1/1954 | Leystra . | |
| 2,687,267 | 8/1954 | Copenhaver . | |
| 2,821,230 | 1/1958 | May . | |
| 3,133,550 | 5/1964 | Brown | 135/102 |
| 3,491,895 | 1/1970 | Warwick et al. . | |
| 3,506,231 | 4/1970 | Bonneau . | |
| 3,527,356 | 9/1970 | Herdy . | |
| 3,550,601 | 12/1970 | Peters | 135/102 |
| 3,642,145 | 2/1972 | Shelton . | |
| 3,907,117 | 9/1975 | Williams | 211/71 |
| 4,043,368 | 8/1977 | Forte, Sr. . | |

*Primary Examiner*—William E. Lyddane
*Assistant Examiner*—Joseph Falk
*Attorney, Agent, or Firm*—Luedeka & Neely

[57] ABSTRACT

The specification discloses an apparatus for supporting and protecting a plurality of garbage cans which includes a base, a vertical post at the approximate center of the base, a structure for supporting the garbage cans which is free to rotate, and a plurality of rollers between the base and the support structure. In addition, a flexible mesh cover is demountably attached to the vertical post. The mesh cover includes hoops for holding its shape and facilitating removal of the cover.

12 Claims, 3 Drawing Figures

ROTATING GARBAGE CAN RACK WITH COVER

The present invention relates to garbage can racks, and particularly relates to garbage can racks which protect and permit rotation of the garbage cans.

A large variety of devices have been developed to facilitate the storage, movement, and protection of garbage cans. One type of such device is a rotatable garbage can rack in which a sleeve mounted upon a vertical post carries a plurality of garbage cans. Because the post in these devices carries all of the weight, generally there have been problems with the sleeve binding on the post unless an expensive bearing system is used.

Typically, existing rotatable garbage can racks do not provide adequate protection of the garbage cans. When cans are stored outdoors, there are problems with wind blowing the lids off or even blowing the cans over. In addition, animals have been able to gain access to or have been able to knock the cans over.

The garbage can rack of the present invention provides a solution to these and other problems. In accordance with one aspect of the present invention, the garbage cans are supported by a support structure which is free to rotate on a system of rollers above a base. A single flexible mesh cover is attached to the top of a central post so that all of the cans are covered. The cover is removable for access to the cans.

The rotation system of the present invention provides several advantages. The cans are supported at their bases and many different sized cans, or even bent or damaged cans may be accommodated. The system of rollers in the preferred embodiment may be constructed from sturdy inexpensive parts and, because the roller system eliminates the need for an expensive central bearing on the post, the entire device may be manufactured inexpensively. The garbage support means is constructed so that rain water will drain off and, consequently, metal cans stored on the device will be less likely to rust.

In accordance with another aspect of the invention, a vertical post extends upwardly from a base, and a support structure mounted on the base receives and supports the garbage cans. A flexible mesh cover is attached to the top of the post and protects the cans from intrusion by animals and keeps the lids on the garbage cans in place. Because the cover is made from a mesh, the cover itself will not be greatly affected by the wind. The cover can be made from strong lightweight material such as nylon netting.

One important advantage of the present invention results from the rotating nature of the garbage can support mechanism in cooperation with the flexible mesh cover. An animal that jumps on a particular can will find that not only is his access blocked by the cover, but also that the can will move away from him beneath the cover. This will frustrate and often frighten the intruding animal away.

In one embodiment of the present invention, an apparatus is provided for supporting and protecting a plurality of garbage cans including three base arms for supporting the apparatus on the ground or other support surface. Each of the base arms is attached to a base sleeve. A tubular post is positioned vertically inside the base sleeve and extends upwardly therefrom, and a retaining ring is mounted about the post, supports the post on the base sleeve, and allows the post to rotate. A gargage can support sleeve is mounted for rotation on the post above the retaining ring. Three garbage can support arms are connected to the garbage can support sleeve, and three arced tubing sections connect between the garbage can support arms to form a ring. Three rollers are mounted to the upper surface of the base to contact and support the ring and to allow rotation of the garbage can support arms, arced tubing sections, and garbage can support sleeves collectively. Garbage can retention brackets are welded to the upper surfaces of the garbage can support arms for retaining the garbage cans in a desired position. A single flexible cover made of a strong and lightweight mesh material is attached at the top of the post. A handle is connected to the cover and an engagement member, connected to the handle, is inserted into a receiver portion of the post to provide for attachment of the cover to the post. A first hoop is attached to the cover near the tops of the garbage cans to suspend and maintain the shape of the cover. A second hoop is attached near the bottom of the cover to further maintain the side portions of the cover in a cylindrical configuration. A keeper sleeve with hoops is disposed about the post for use in fastening the cans to the post.

The present invention may best be understood, and additional advantages and aspects are readily apparent, by reference to the following detailed description of a preferred embodiment when considered in conjunction with the accompanying drawings in which.

Figure 1:
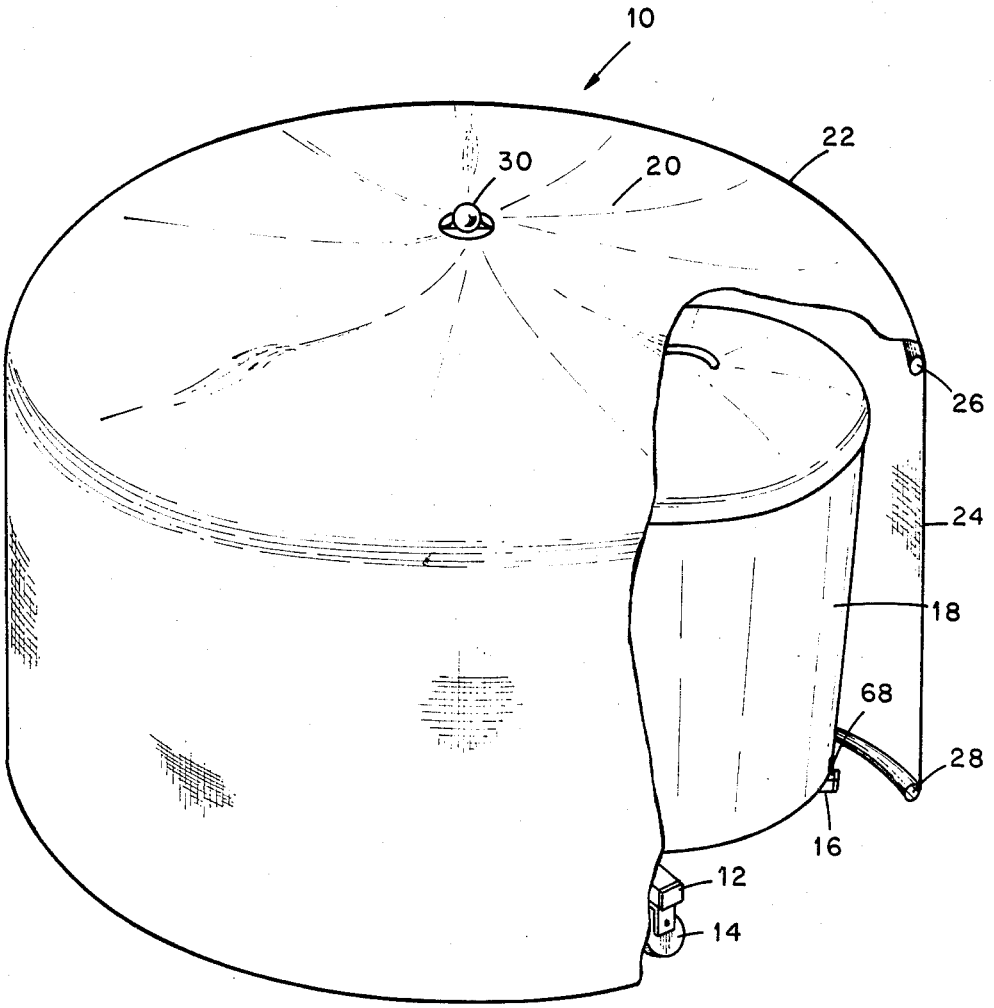
FIG. 1 is a perspective, partially broken away view of a garbage can rack and cover of the present invention.

Referring now to the drawings in which like reference characters designate like or corresponding parts throughout the several views, FIG. 1 is a perspective, partially broken away view of a garbage can rack 10 embodying one form of the present invention. Garbage can rack 10 includes base arms 12 visible in the broken away area to which are attached wheels 14 for moving and supporting the device on the ground or other support surface. Garbage can support arms 16 are mounted on the apparatus in a plane above and parallel to the base arms 12 for receiving and supporting garbage cans 18. A cover 20 is demountably attached to the device to cover and protect the garbage cans 18, and is removable from the apparatus to gain access to the garbage cans 18. Cover 20 is made from a flexible mesh material such as nylon netting which is both strong and lightweight. In this preferred embodiment, the cover 20 is constructed of two segments 22 and 24 of nylon netting. The first cover segment 22 is circular in shape and of sufficient size to cover the tops of the garbage cans 18. The second cover segment 24 is cylindrical in shape and is oriented to enclose the sides of the garbage cans 18. A first circular hoop 26 is attached at the transition between the first cover segment 22 and the second cover segment 24 to maintain the shape of and to suspend cover 20 above and about the garbage cans 18. A second circular hoop 28 is attached at the bottom of second cover segment 24 to support and maintain the approximately cylindrical configuration of second cover segment 24. A handle 30 is located in the center of the first cover segment 22 to facilitate removal and replacement of the cover 20.

Most load-bearing parts in the apparatus 10 of this embodiment are made of metal. Hoops 26 and 28 are made of a lightweight resilient material such as wood or plastic. The handle 30 is made from a lightweight material such as wood or a rigid plastic.

Figure 2:
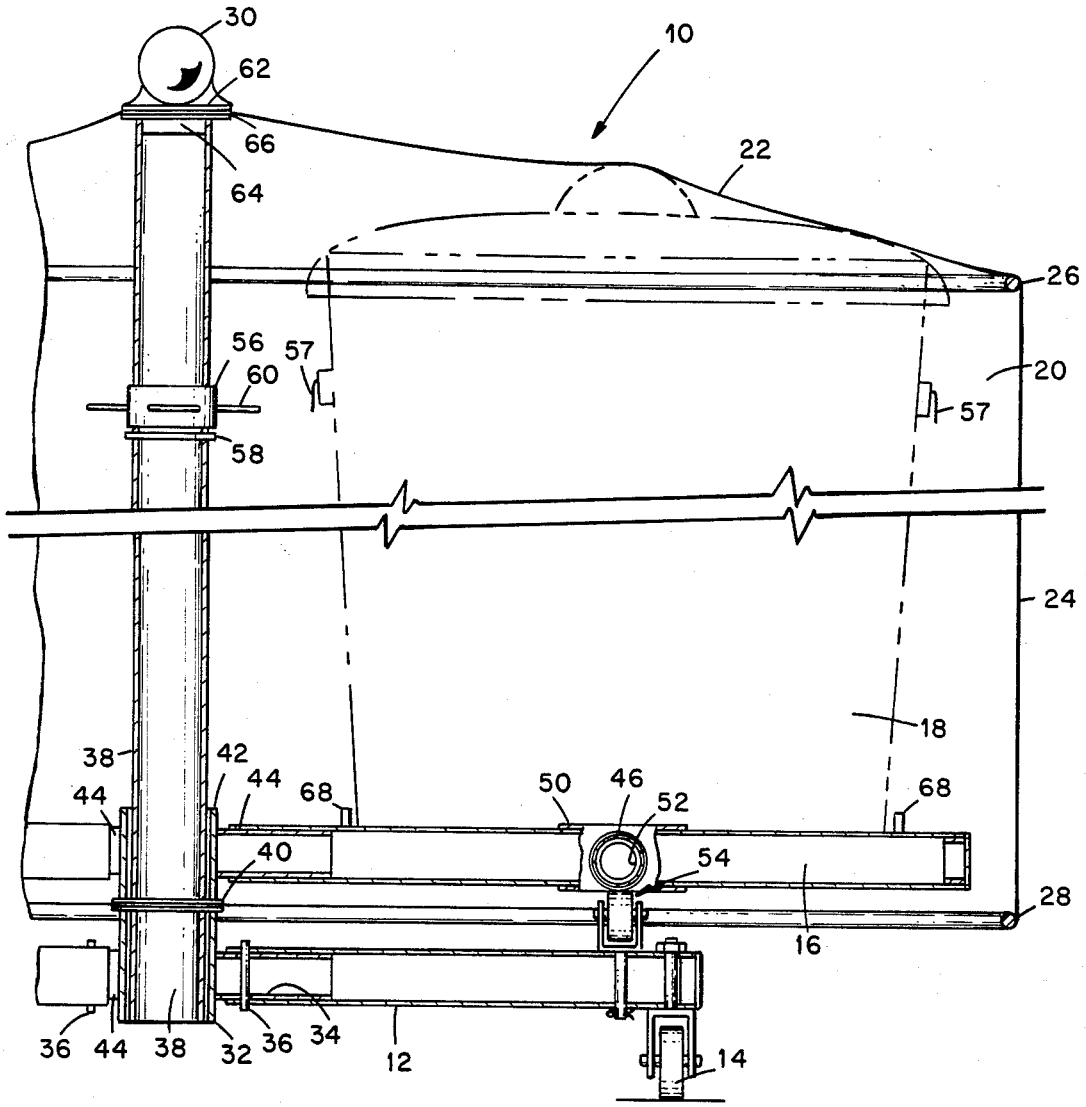
FIG. 2 is a somewhat diagrammatical side cross-sectional view of the center and one side of the gargage can rack and cover with a garbage can support arm shown directly above a base arm.
Figure 3:
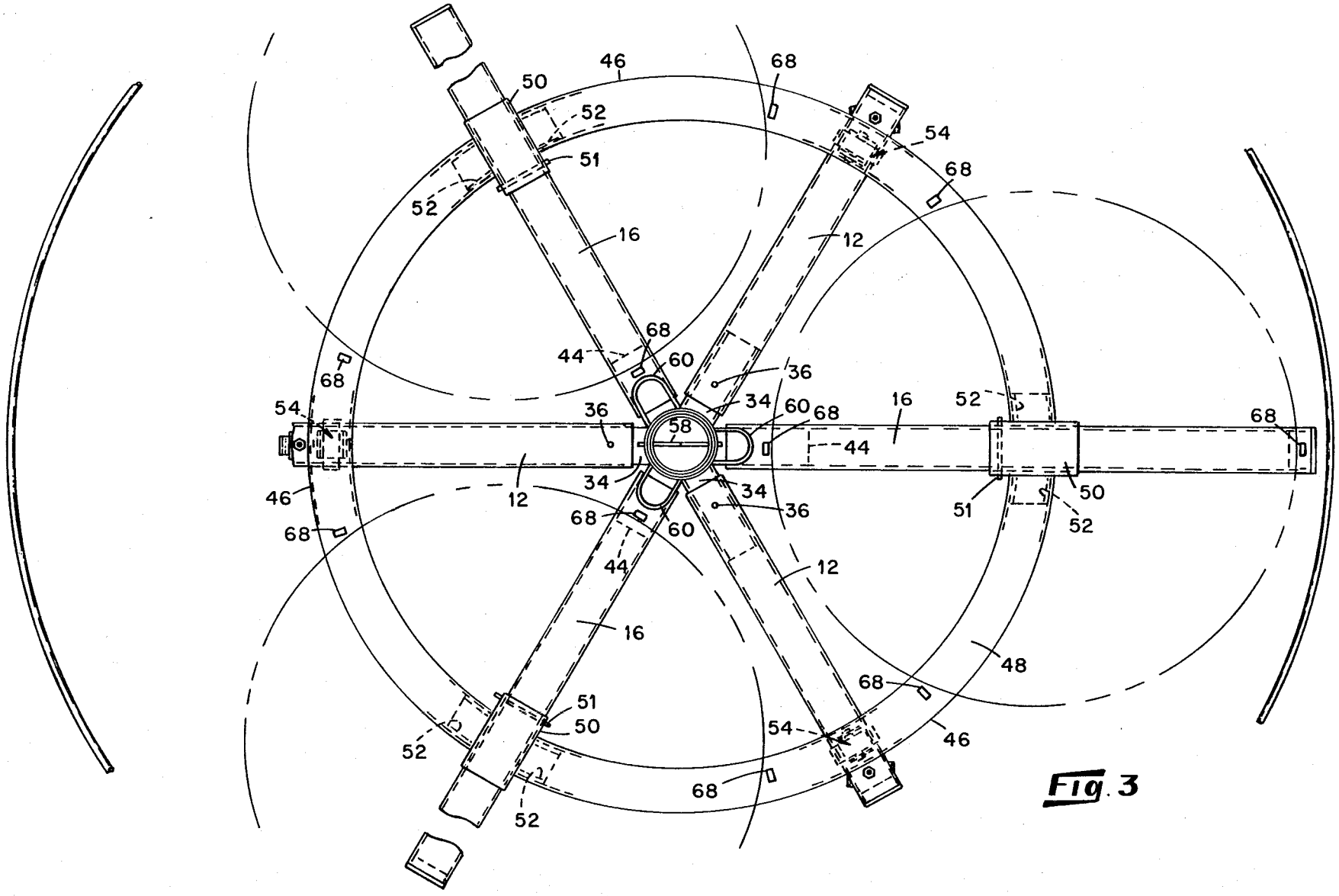
FIG. 3 is a somewhat diagrammatical top cross-sectional view of the garbage can rack and cover with the garbage can support arms shown in positions between the base arms.

Referring now to FIG. 2, there is shown a somewhat diagrammatical side cross-sectional view of the center and one side of the garbage can rack 10. A base sleeve 32 is disposed vertically in the center of the rack 10 and is connected to the base arms 12 by means of base studs 34. The base studs 34 are welded to the base sleeve 32 and the base arms 12 are mounted over the base studs 34. As best shown in FIG. 3, there are three base arms 12 and three base studs 34 (one of each being shown in its entirety in FIG. 2) that extend radially in a direction perpendicular to the center line of the sleeve 32 at angular spacing of 120°. The base arms 12 and the base studs 34 are fastened together with base pins 36.

FIG. 2 shows that a tubular post 38 is positioned vertically inside of base sleeve 32 and extends upwardly. The post 38 is held in position approximately perpendicular to the plane defined by the base arms 12 and is free to rotate within the base sleeve 32. A retaining ring 40 is fixedly attached to and about the post 38 for retaining the post 38 in a fixed vertical position by preventing the post 38 from sliding downwardly through the base sleeve 32. The retaining ring 40, while in contact with base sleeve 38, permits rotation of the post 38 within the base sleeve 32 while supporting the post 38 in its upright position above the base sleeve 32.

A garbage can support sleeve 42 is mounted about the post 38 above the retaining ring 40. In this embodiment, the garbage can support sleeve 42 is in contact with and is vertically supported by the retaining ring 40. Garbage can support studs 44, welded to the support sleeve 42, are used to connect the garbage can support arms 16 to the garbage can support sleeve 42. The garbage can support arms 16 mount over garbage can support studs 44 and are welded or otherwise attached thereto. As is best shown in FIG. 3, there are three garbage can support studs 44 (one of each being shown in its entirety in FIG. 2) that extend radially in a direction perpendicular to the centerline of the garbage can support sleeve 42 at angular spacing of 120°.

FIG. 3 also shows that three arced tubing sections 46 are attached between the garbage can support arms 16 to form a continuous ring 48 in approximately the same plane as the garbage can support arms 16 and with the garbage can support sleeve 42 at its center. The ring 48 of tubing thus formed incorporates the width of the three garbage can support arms 16 into its circumference. Consequently the three arced tubing sections 46 each measure slightly less than 120° of the total angular measurement of the ring 48. FIG. 3 also best shows the method for attaching the three arced tubing sections 46 to the three garbage can support arms 16. Three square sleeves 50 are disposed about the garbage can support arms 16 and are fastened thereto with three square sleeve pins 51. Two tubing studs 52 are welded onto each square sleeve 50, and each arced tubing section 46 fits over a tubing stud 52 on each of the two garbage can support arms 16 to which it is connected.

FIG. 2 shows the location of the tubing studs 52 on the square sleeve 50. The tubing studs 52 are disposed so that when the arced tubing sections 46 are attached, the lower surfaces of the tubing sections 46 are flush with the bottom surfaces of the square sleeves 50. Three rollers 54 (one of which is shown in FIG. 2) are mounted on the upper surface of the base arms 12 with the rolling directions perpendicular to the base arm 12 to which the roller 54 is attached. The rollers 54 are disposed on the base arms 16 so that the rollers 54 are in contact with the bottom surface of the ring 48 formed by the arced tubing sections 46 and the square sleeves 50.

Referring now to the upper midsection of post 38 in FIG. 2, a garbage can keeper sleeve 56 is mounted about the post 38 adjacent to the location of handles 57 on the garbage cans 18. Retaining pin 58 passes through and is fastened to the post 38 beneath the keeper sleeve 56 to prevent the keeper sleeve 56 from sliding downwardly. FIGS. 2 and 3 show loops 60 attached to keeper sleeve 56 in a plane perpendicular to the centerline of the keeper sleeve 56 with angular spacing between the loops 60 of 120°. The loops 60 are used to tie or otherwise fasten the garbage cans 18 to the apparatus 10.

FIG. 2 shows the handle 30 used for removing and replacing the cover 20. The handle 30 widens into a bottom flared section 62 with a flat circular bottom surface. An insertion member 64 of cylindrical configuration is connected to and is continuous with the flared section 62 and is dimensioned for insertion into the tubular post 38. The handle 30 is attached to the cover 20 by a washer 66 which clamps the cover 20 between the flat circular surface of the flared section 62 and the top surface of the washer 66. An opening is formed in cover 20 for the insertion member to pass therethrough. The washer 66 is disposed about the insertion member 62 and is attached to the flared section 62 by screws, glue, or other suitable devices that will penetrate the mesh cover 22 that is disposed between the flared section 64 and the washer 66.

As shown in FIG. 2, garbage can retention brackets 68 are welded to the upper surfaces of the garbage can support arms 16 and to the upper surface of the arced tubing sections 48 for retaining the garbage cans 18 in a selected position in the apparatus. Twelve garbage can retention brackets 68 are used, (two of which are shown in FIG. 2 and ten of which are shown in FIG. 3) four brackets for each of the three garbage cans 18.

By referring again to FIG. 1, the operation of the garbage can rack 10 may be elucidated. Garbage cans 18 are shown stored in the apparatus 10. To gain access to the cans 18, handle 30 is grasped in the user's hand and is lifted upwardly. The lifting of the handle 30 causes insertion member 62 to be removed from its position inside the post 38 (see FIG. 2). The cover 20, attached to the handle 30, is thus lifted high enough for the second cover segment 24 to clear the garbage cans and the top of the post 38. Hoops 26 and 28, attached to the cover 20, are removed by this action as well. Hoops 26 and 28 aid in the removal of the cover 20 by suspending and maintaining the shape of the cover when it is lifted from the apparatus.

With the cover 20 removed, the garbage cans 18 are free to rotate. The user selects a garbage can 18 in which he desires to deposit garbage or a garbage can 18 which he desires to empty. If this can is in a position in the device which is inconvenient for access from where the user is standing, he rotates the garbage cans 18 by pushing either on the garbage cans 18 or on the support arms 16 until the selected garbage can 18 is in a convenient position for access.

The retention brackets 68 hold the garbage cans 18 in position when the garbage cans 18 are rotated in the device. For additional protection of the garbage cans 18, handles on the sides of the garbage cans 18 are tied or otherwise connected to loops 60. If the garbage cans 18 have been tied to the apparatus by loops 60, it is necessary, of course, to untie them before the garbage cans may be removed from the apparatus. Loops 60 being mounted on keeper sleeve 56 are free to rotate about the post 38. Thus, loops 60 will remain properly aligned with the garbage cans 18 fastened to the loops 60 when the garbage cans 18 are rotated.

The apparatus protects the garbage cans from intruding animals when the cover 20 is in place. The cover 20 itself provides physical protection from intrusion. Moreover, additional protection is provided by the capability of parts of the device to rotate. When an intruding animal jumps on the cover 20, the cover 20 will rotate with respect to the ground because post 38 is free to rotate. The garbage cans 18, if contacted by the animal through the cover 20, will also rotate with respect to the ground. There is also freedom of rotation between the cover 20 and the garbage can 18. This combined freedom of rotation acts to frustrate attempts of an intruding animal to gain access to the garbage cans 18.

Although a particular embodiment has been described in detail in the foregoing, it will be understood that the present invention is capable of numerous rearrangements, modifications and substitutions of parts without departing from the spirit of the invention.

What is claimed is:

1. An apparatus for supporting and protecting a plurality of garbage cans, comprising:

a base having an upper and a lower surface;

a post extending generally vertically upwardly from said base;

garbage can support means for supporting the plurality of garbage cans, a plurality of rollers disposed between said base and said garbage can support means, said rollers being radially spaced-apart from said post;

said garbage can support means being supported for rotation above said base by said rollers so that said garbage can support means is rotatable about said post on said rollers, said garbage can support means being configured to receive and support the plurality of garbage cans in an upright position on the upper surface of said support means;

single flexible cover means for covering the plurality of garbage cans when supported on said garbage can support means;

attachment means for detachably attaching said flexible cover means to the top of said post so that said cover means is removable from the apparatus.

2. The apparatus of claim 1, further comprising a plurality of wheels mounted on the lower surface of said base for supporting the apparatus for rolling motion.

3. The apparatus of claim 1 wherein said single flexible cover means comprises:

a first segment of flexible mesh material attached to the attachment means and extending radially outwardly therefrom for covering the tops of the garbage cans when supported on said support means; and a second segment of flexible mesh material continuous with said first segment, said second segment of flexible mesh material extending downwardly to enclose the garbage cans within said cover means.

4. The apparatus of claim 3 further comprising:

a first hoop attached to said flexible cover means at the transition between said first and second segments of flexible mesh material, said first hoop being suspended adjacent to the top of the garbage cans and operable to support and hold said first segment of flexible mesh material in a circular configuration adjacent to the tops of the garbage cans;

a second hoop attached at the lower end of said second segment of flexible mesh material and adjacent to said support means, said second hoop being operable to hold the lower end of said second segment of flexible mesh material in a circular configuration adjacent to the bottom of the garbage cans;

said single flexible cover means encompassing the garbage cans and having a cylindrical configuration extending betwen said first hoop and said second hoop encompassing the garbage cans; and said single flexible cover means supported in a vertical hanging position only by its attachment to said post and by the tops of the garbage cans.

5. The apparatus of claim 4 wherein said attachment means comprises:

a receiver disposed adjacent to the top of said post; and an engagement member attached to said flexible cover means for attachment, deattachment, and reattachment to said receiver.

6. The apparatus of claim 1 further comprising a handle attached to said attachment means for use in detaching said single flexible cover means from said post and removing and lifting said single flexible cover means from the apparatus.

7. An apparatus for supporting and protecting a plurality of garbage cans above a support, comprising:

a base for being supported above the support surface having an upper and a lower surface;

a tubular post extending vertically upwardly from the approximate center of said base;

a plurality of rollers mounted in fixed positions on the upper surface of said base;

a garbage can support sleeve disposed about said post;

a plurality of arms extending radially outwardly from said sleeve;

a circular ring of tubing mounted on said arms coaxially with respect to said sleeve, said ring being in contact with and supported by said rollers for rotation about said post;

said ring and said plurality of arms being disposed in a substantially coplanar relationship and being interconnected for supporting the plurality of garbage cans;

single flexible cover means constructed of a mesh material for covering the plurality of garbage cans when supported on said ring and said arms; and attachment means for detachably attaching said flexible cover means to the top of said post.

8. The apparatus of claim 7 further comprising:

retention means attached to the upper surfaces of said arms and said ring for retaining the garbage cans in a selected position on said arms and said ring;

a plurality of wheels mounted on the lower surface of said base for supporting the apparatus for rolling motion on the support surface.

9. The apparatus of claim 7 wherein said single flexible cover means comprises:

a first segment of flexible mesh material attached to said attachment means and extending radially outwardly therefrom for covering the tops of the garbage cans when supported on said support means;

a second segment of flexible mesh material continuous with said first segment, said second segment of flexible mesh material extending downwardly to enclose the garbage cans within said cover means;

a first hoop attached to said flexible cover means at the transition between said first and second segments of flexible mesh material, said first hoop being suspended adjacent to the top of the garbage cans and operable to hold said first segment of flexible mesh material in a circular configuration adjacent to the tops of the garbage cans;

a second hoop attached at the lower end of said second segment of flexible mesh material and adjacent to said support means, said second hoop being operable to hold the lower end of said second segment of flexible mesh material in a circular configuration adjacent to the bottom of the garbage cans;

said single flexible cover means encompassing the garbage cans and having a cylindrical configuration extending between said first hoop and said second hoop encompassing the garbage cans; and said single flexible cover means supported in a vertical hanging position only by its attachment to said post and by the tops of the garbage cans.

10. The apparatus of claim 9 wherein said attachment means comprises:

a receiver disposed adjacent to the top of said post; and an engagement member attached to said flexible cover means for attachment, deattachment and reattachment to said receiver and being shaped and dimensioned to mate with said receiver.

11. The apparatus of claim 10 further comprising:

a keeper sleeve disposed about said post above said garbage can support means;

means for securing said keeper sleeve for rotation on said post; and means for fastening the garbage cans to said keeper sleeve.

12. The apparatus of claim 11 wherein said base comprises:

a base sleeve disposed about said post;

a plurality of arms extending radially outwardly from said base; and a retaining ring disposed about and attached to said post above said base sleeve and below said garbage can support sleeve, said retaining ring in contact with said base sleeve and said garbage can support sleeve and dimensioned to support said post for rotation within said sleeve and to support said garbage can support sleeve for rotation about said post.

* * * * *